US007497273B2

(12) United States Patent
Schoettle

(10) Patent No.: US 7,497,273 B2
(45) Date of Patent: Mar. 3, 2009

(54) PLUG AND PLAY UTILITY CONTROL MODULES

(75) Inventor: Roland Schoettle, American Canyon, CA (US)

(73) Assignee: Optimal Innovations, Inc., Freeport GBI (BS)

( * ) Notice: Subject to any disclaimer, the term of this patent is extended or adjusted under 35 U.S.C. 154(b) by 0 days.

(21) Appl. No.: 11/683,335

(22) Filed: Mar. 7, 2007

(65) Prior Publication Data

US 2008/0219029 A1 Sep. 11, 2008

(51) Int. Cl.
*H01H 9/02* (2006.01)

(52) U.S. Cl. ..... 173/53; 174/54; 439/535

(58) Field of Classification Search ..... 439/535, 439/538, 209; 174/60, 50, 53, 54; 362/659
See application file for complete search history.

(56) References Cited

U.S. PATENT DOCUMENTS

| | | | | |
|---|---|---|---|---|
| 1,938,309 | A * | 12/1933 | Williams | 174/55 |
| 2,014,444 | A * | 9/1935 | Miller | 340/396.1 |
| 2,908,743 | A * | 10/1959 | Premoshis | 174/53 |
| 3,860,739 | A * | 1/1975 | Kloth et al. | 174/503 |
| 3,879,101 | A * | 4/1975 | McKissic | 439/535 |
| 4,632,476 | A | 12/1986 | Schell | |
| 4,964,058 | A | 10/1990 | Brown, Jr. | |
| 5,064,387 | A | 11/1991 | Lybrand | |
| 5,424,859 | A | 6/1995 | Uehara et al. | |
| 6,217,391 | B1 | 4/2001 | Colantuono et al. | |
| 6,348,911 | B1 | 2/2002 | Rosenberg et al. | |
| 6,898,618 | B1 | 5/2005 | Slaughter et al. | |
| 6,940,016 | B1 * | 9/2005 | Cornett et al. | 174/58 |
| 6,957,043 | B2 | 10/2005 | Angermann et al. | |
| 6,967,565 | B2 | 11/2005 | Lingemann | |
| 7,038,657 | B2 | 5/2006 | Rosenberg et al. | |
| 7,102,541 | B2 | 9/2006 | Rosenberg | |
| 7,160,147 | B1 * | 1/2007 | Stephan | 439/535 |
| 2004/0242290 | A1 | 12/2004 | Keeling | |
| 2006/0276144 | A1 | 12/2006 | Campbell | |
| 2008/0011501 | A1 * | 1/2008 | Gates et al. | 174/50 |

FOREIGN PATENT DOCUMENTS

| | | | |
|---|---|---|---|
| DE | 202004014389 | U1 | 8/2005 |
| JP | 61046632 | U1 | 3/1986 |
| WO | WO-2004/066539 | A2 | 8/2004 |
| WO | WO-2006/024609 | A1 | 3/2006 |

OTHER PUBLICATIONS

Extended European Search Report for European Patent Application No. 08251799.6, dated Jul. 29, 2008.

* cited by examiner

*Primary Examiner*—Michael C Zarroli
(74) *Attorney, Agent, or Firm*—Kilpatrick Stockton LLP

(57) ABSTRACT

A utility control device, such as a light socket, a switch or a plug socket, is designed with universal terminals so that when plugged into a pre-wired utility box (box socket), the terminals will make the proper electrical connections with the premises wiring. Systems and methods are disclosed for arranging the premises power grid such that any device type can be "plugged" into the shells that are pre-wired inside the utility box.

5 Claims, 7 Drawing Sheets

PLUG AND PLAY UTILITY CONTROL MODULES

CROSS-REFERENCE TO RELATED APPLICATIONS

The present application is related to concurrently filed, co-pending, and commonly-assigned; U.S. patent application Ser. No. 11/683,304, entitled "SYSTEMS AND METHODS FOR LINKING UTILITY CONTROL DEVICES"; U.S. patent application Ser. No. 11/683,327, entitled "SYSTEM AND METHOD FOR INFRASTRUCTURE REPORTING"; U.S. patent application Ser. No. 11/683,298, entitled "LIGHT SWITCH USED AS A COMMUNICATION DEVICE"; U.S. patent application Ser. No. 11/683,308, entitled "SYSTEM AND METHOD FOR PREMISES MONITORING USING WEIGHT DETECTION"; U.S. patent application Ser. No. 11/683,326, entitled "ANTICIPATORY UTILITY CONTROL DEVICE"; and patent application Ser. No. 11/683,354, entitled "SYSTEM AND METHOD FOR SUBSTITUTING DATA IN RESPONSES TO MULTIMEDIA INQUIRIES"; the disclosures of which are hereby incorporated herein by reference.

TECHNICAL FIELD

This disclosure relates to utility control devices and more particularly to such devices that are modular and used in a plug and play manner.

BACKGROUND OF THE INVENTION

Utility control devices, such as light switches, dimmers, sockets and the like, are in common use today in various environments, such as homes, offices and factories. While great advances have been made in materials and in the manufacture of these devices, the actual manner in which the devices are wired into circuits has not changed significantly over the years since their first introduction into construction. Thus, electrical power is distributed throughout a premises by running individual wires from a power source to a load with branches run to locations where switches are to be wired into the circuit. These switches, as is well-known, are used to control power to fixed lights, to power outlets (wall sockets) and to a myriad of other devices. Typically, in the United States, this wiring carries 110 Volts, 60 cycle AC and in some countries 220 Volts 50 cycle AC. The wiring terminates in a metal or polymer box (utility box) and then a switch or other device is manually connected to the wires in the utility box. The electrical device is then fastened into the utility box and a face plate covers the device and covers any exposed wiring.

The plate serves the function of making the device less obtrusive to a decorated room as well as serving to keep fingers out of harms way, i.e., avoiding electrocution. The electrocution issue, along with fire hazard issues also arise when a person desires to change a switch, either because an existing device fails, or because it is desired to place another type of device in its place.

In addition to the above-discussed dangers of changing an electrical power control device, a further problem exists because the wires are pre-run to each outlet box. For example, if a person desires to convert a switch box to a socket (assuming the height and position of the box were otherwise acceptable) it would often be impossible since the wiring to the box often only contains the switched leg (for example only the black wire leg) of the circuit and not both legs (black and white wires) of the AC circuit.

Recently, as shown in one or more of the above-identified patent applications, there has been a desire to consolidate a number of operations into a single location. These operations have historically been performed by individual controls dedicated to each function. For example, a typical home has a controller for the thermostat, one for an alarm system and a number of controllers for each light in the home. When designing a home (or office or any other space) one of the challenges facing the designer is where to place all of these controls. This has often resulted in a number of switches being placed together for controlling a number of similar functions. Rearranging the location of one or more of these switches after construction is finished is at best a difficult process typically only performed by experienced and expensive skilled labor. It is common for the labor costs to be many times the cost of the device itself.

BRIEF SUMMARY OF THE INVENTION

A utility control device, such as a light socket, a switch or a plug socket, is designed with universal terminals so that when plugged into a pre-wired utility box (box socket), the terminals will make the proper electrical connections with the premises wiring. In one embodiment, a "shell" is inserted into a common utility box. The shell would then be wired to the building wiring on the "back-side" of the shell and when the shell is installed within the utility box the wiring is sandwiched inside the box and behind the shell and therefore not easily seen. A standard socket is positioned within the shell and provides a quick no-wiring required connection to the mating terminals on the actual device, for example a light-switch, or plug, or thermostat, or any other device normally installed and wired as a permanent fixture. Systems and methods are disclosed for arranging the premises power grid such that any device type can be "plugged" into the shells that are pre-wired inside the utility boxes. In one embodiment, the grid is constructed exactly as it has always been with each box pre-established for a particular type of control but with a plug/play adapter. In another embodiment, the grid is universally wired and each device instructs the system as to its type and as to its intended use. In operation, such a universal plan would allow a device, for example, to "announce" what light, or set of lights, it will control. The system can handle power wiring as well as control wring.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims. The novel features which are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention.

BRIEF DESCRIPTION OF THE DRAWINGS

For a more complete understanding of the present invention, reference is now made to the following descriptions taken in conjunction with the accompanying drawings, in which.

DETAILED DESCRIPTION OF THE INVENTION

Figure 1:
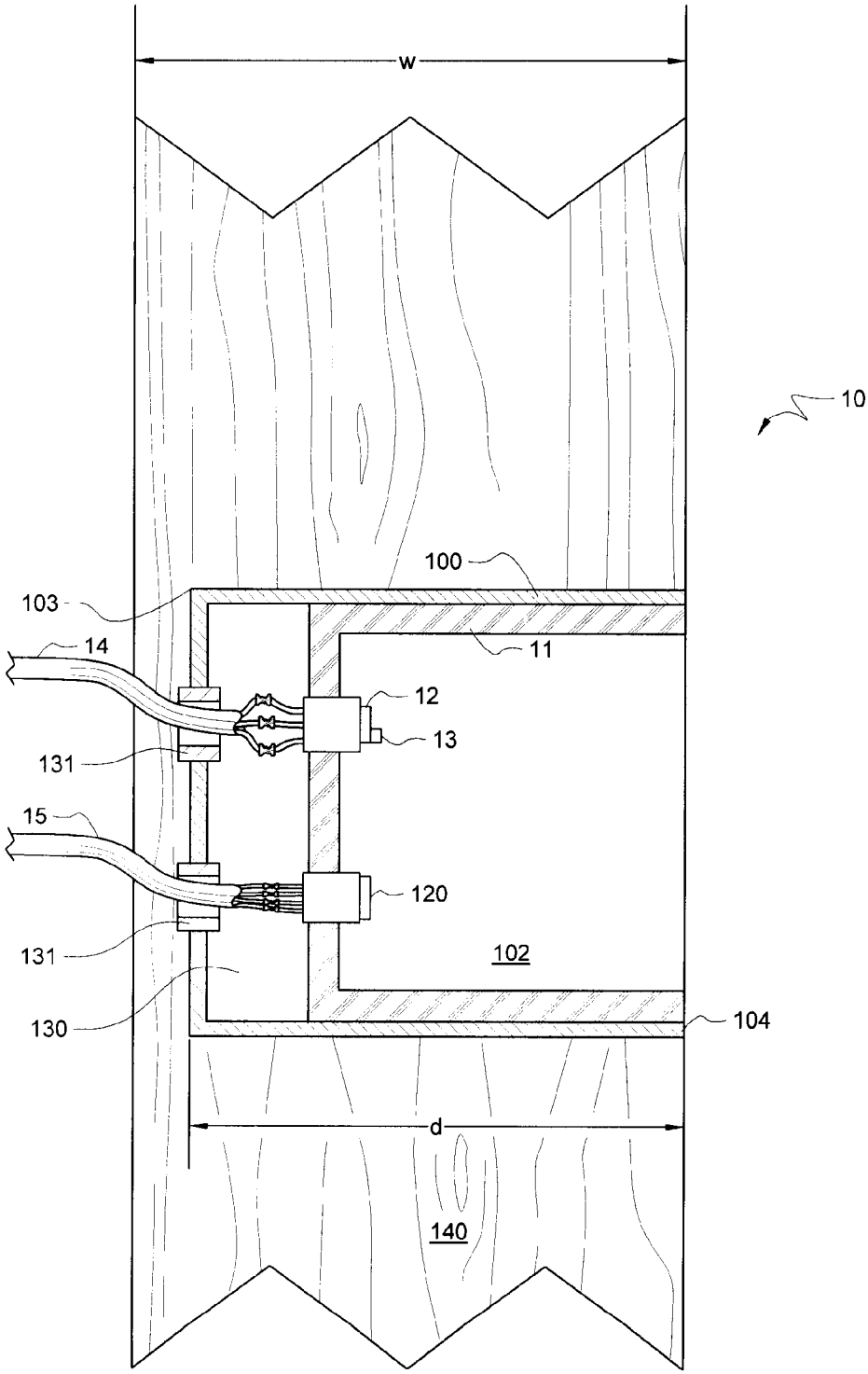
FIG. 1 shows one embodiment of an illustrative plug ad play utility box mounted to a construction stud.

FIG. 1 shows one embodiment 10 of an illustrative plug and play system using shell 11 inserted into a utility box, such as box 100. While not necessary, it is anticipated that many such utility boxes will be permanently fastened to studs, such as stud 140, or to other structural supports of a premises. Ideally, each box 100 would have a depth d no greater than (and presumably slightly less than) width w of the stud to which it is attached. The utility boxes can be constructed from any material, such as for example, metal or plastic. Such boxes would typically be mass-produced and sold in bulk. Shell 11 would have a depth less than "d" so as to form area 130 behind shell 11 and in front of back 103 of box 100. The wiring, such as wiring 14 and 15, that interconnects the boxes can be individual wires or preformed cables which are plugged into connector 12 or, when the shell is used, connected to connector(s) 12 (120) within space 130. This wiring typically would be added by an electrician after the box is fastened to a particular structural member with the utility wires entering the rear of box 100 and held in place, for example, by clamps 131. When shell 11 is mated and secured within box 100 this wiring is hidden from view and away from fingers and tools. Shell 11 can be secured within box 11 in any well known manner, such as, for example, snaps, clips, screws, force fit and the like.

One or more connectors 12-120, are positioned within shell 11 (or directly within box 100 when the shell is not used) such that contacts 13 of each such connector are open into area 102 of shell 11. This then allows a control device (not shown in FIG. 1) to become mated, both electrically and physically, within box 100. Slots 101 of box 100 serve, if desired, to hold the mated control device within the utility box by mating with tabs on an inserted control device.

As will be discussed, the user then simply pushes in (or pulls out) a control device when desired such that user need not touch the electrical connections within the utility box and does not require an electrician to install or remove the device. These connections (electrical and/or control, and/or communications) are made by the plug on the control device mating with socket 12 or 120. Connector 12 (120) can be designed to snap in and out of shell 11 (or housing 100) which also serves to facilitate wiring to the connector. Note that while the connector is shown on the back wall of the shell, one or more connectors can be placed on any interior surface of the box and any surface of the shell, if desired.

Figure 2:
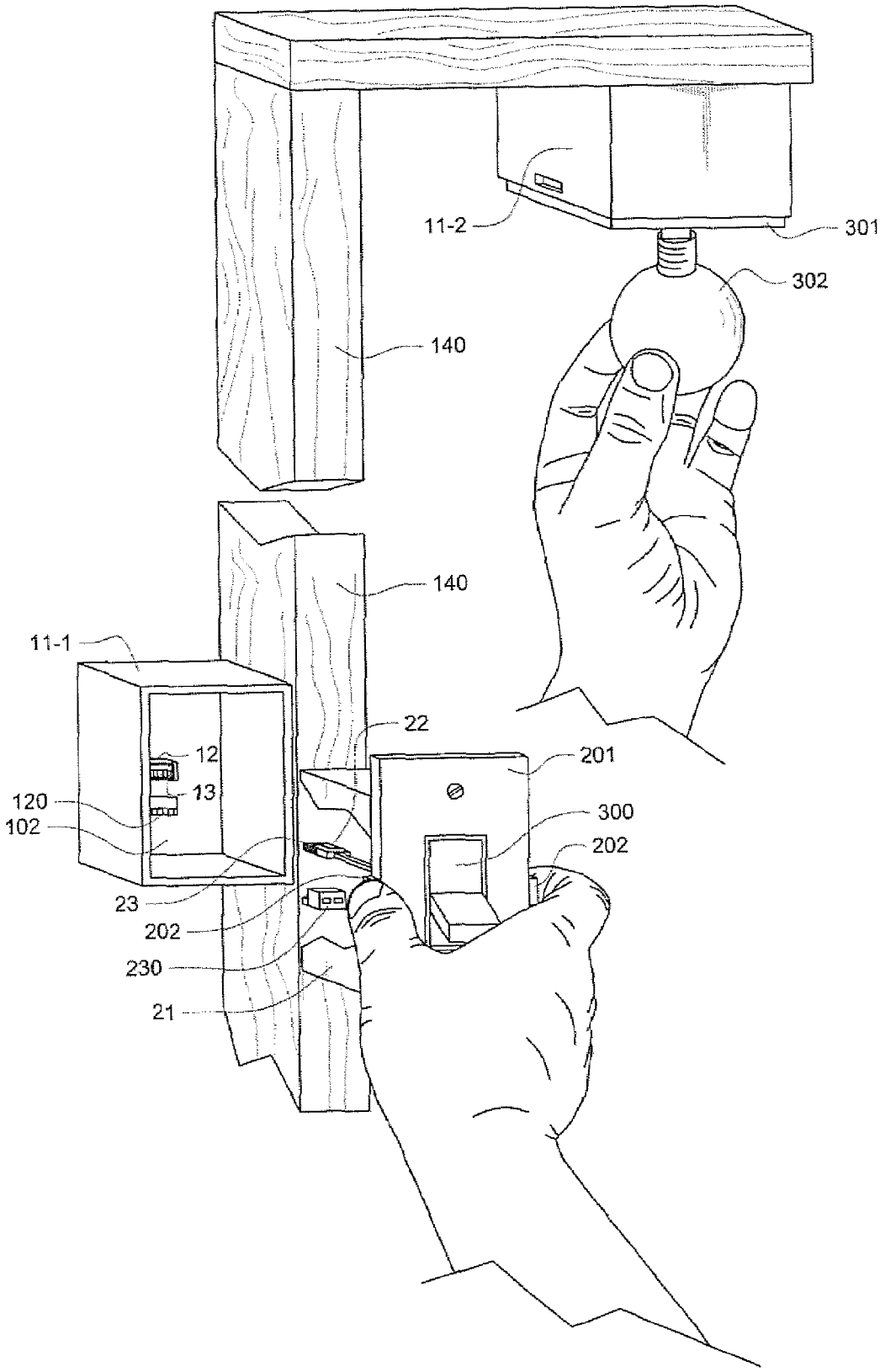
FIG. 2 illustrates one example of the use of plug and play utility boxes in a premises environment.

FIG. 2 illustrates the use of plug and play shell 11-1 shown without utility box 100-1 for simplicity. The utility box(es) would be mounted in a premises environment together with a control device, such as switch 300 about to be mated into shell 11-1. Also shown is a ceiling fixture having shell 11-2 with light socket 301 mated therewith. Light 302 is about to be screwed into socket 301.

Device 300 is a switch (in this case a single-pole single-throw switch) contained within housing 21. Housing 21 (as is housing 301) has a physical design such that it fits within open area 102 of shell 11-1 (or within shell 11-2). The rear surface of housing 21 contains connector 22 having contacts 23 adapted for mating both physically and electrically with connector 12. Connector 22 is rigidly mounted to the rear surface of housing 21 as is connector 230 (if present).

The front portion of housing 21 is covered by, for example, face plate 201. Tabs 202 mate with slots 101 and are used to hold housing 21 firmly in position with respect to shell 11-1. Note that the utility box can be designed to allow housing 22 to mate with it so that shell 11 need not be sturdy enough to hold the housing. This also allows the shell to be optimal, perhaps being used as in a retro fit situation. Shell 11 can be made of any material and typically would be of a plastic non-conductive material.

Figure 3:
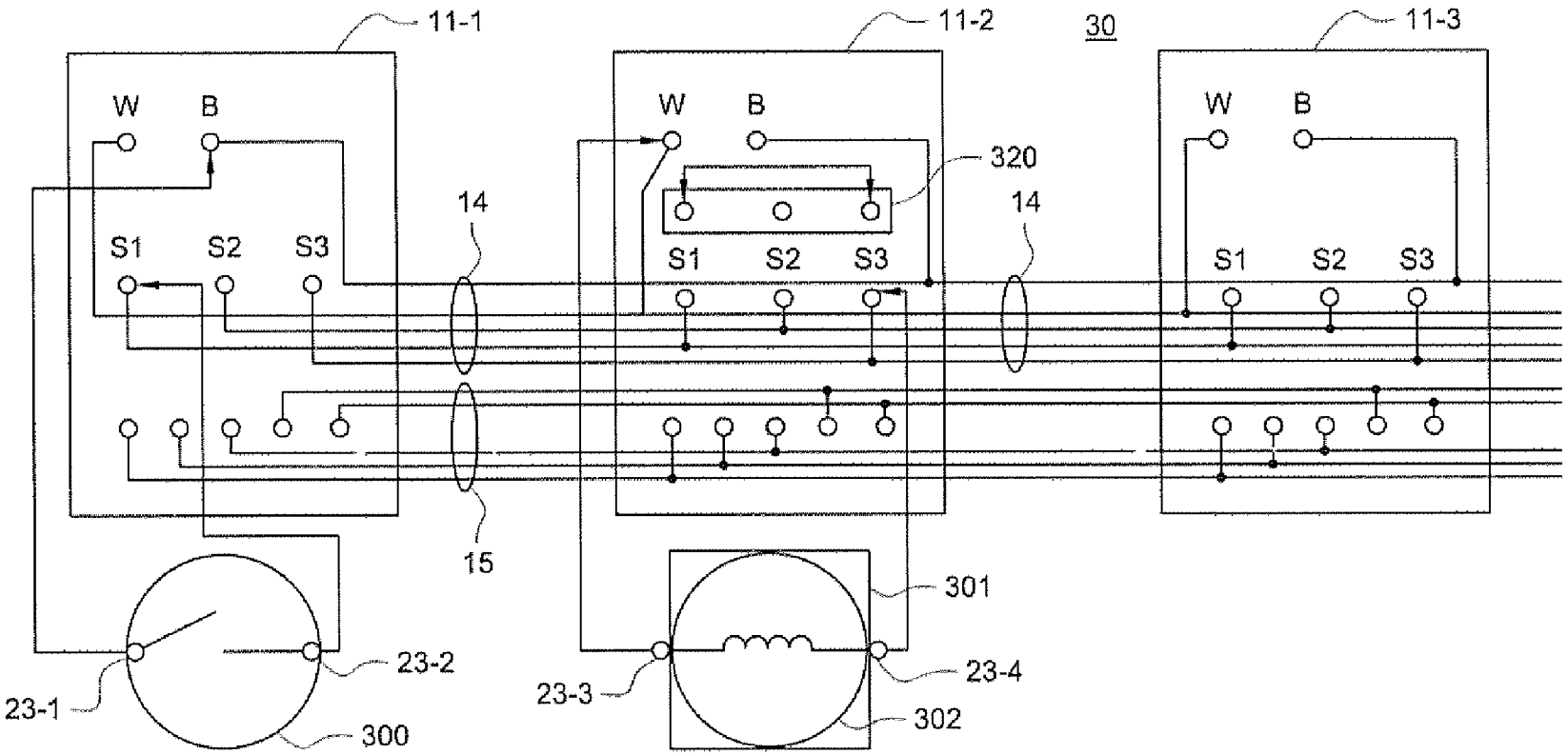
FIGS. 3, 4, 5 and 6 show embodiments of schematics illustrating the plug and play nature of the wiring connections among permanently mounted utility boxes.

FIG. 3 shows one embodiment of a schematic, such as schematic 30, illustrating the plug and play nature of the wiring connections among shells 11-1, 11-2, 11-3 mounted within utility boxes. Terminals W, B, S1, S2, and S3, as well as other terminals are connected to wiring 14 and optionally 15 as shown. Thus, all the similarly lettered terminals are electrically common. Assume that the W terminal is connected to the white wire of the power grid while the B terminal is connected to the black wire of the grid. In this example, a 110V AC grid is assumed, but any power grid can be used.

Switch 300 is shown connected to contacts 23-1 and 23-2 of connector 22 (shown in FIG. 2) such that when switch 300 is mated with connector 12 (FIG. 2) of a junction box, such as shell 11-1, terminal 23-1 is electrically connected to terminal B of connector 12 while terminal 23-2 is electrically connected to terminal S1 of connector 12.

Lamp 302 (or more precisely, device 301, FIG. 2 into which lamp 302 can be mounted) has its terminal 23-3 connected to terminal W of connector 12 in shell 11-2 while terminal 23-4 is connected to terminal S3. Note that bridge connector 320 is used (it desired) to cross-connect terminal S3 to terminal S1. The same electrical effect could be achieved by connecting terminal 23-4 directly to terminal S1. However, to do so would require wiring changes to cable 14 by a user that may not be desired. Note that while bridge 320 is shown, the respective connections can be changed by slipping pins into various locations within the base of connector 22 of device 301 so as to effect the desired cross-connect arrangement.

In operation, when a user operates switch 300, electrical current flows from the black wire of the power grid (terminal B shell 11-1) through switch 300 and via terminal S1 of shell 11-1 to terminal S1 of shell-2 through cross connect bridge 320 to terminal S3 of shell 11-2 to device 301. The other side of device 301 is connected to the white wire of the power grid via terminal W of shell 11-2. This causes lamp 302 to go on and off following the switch operation of switch 300.

Figure 4:
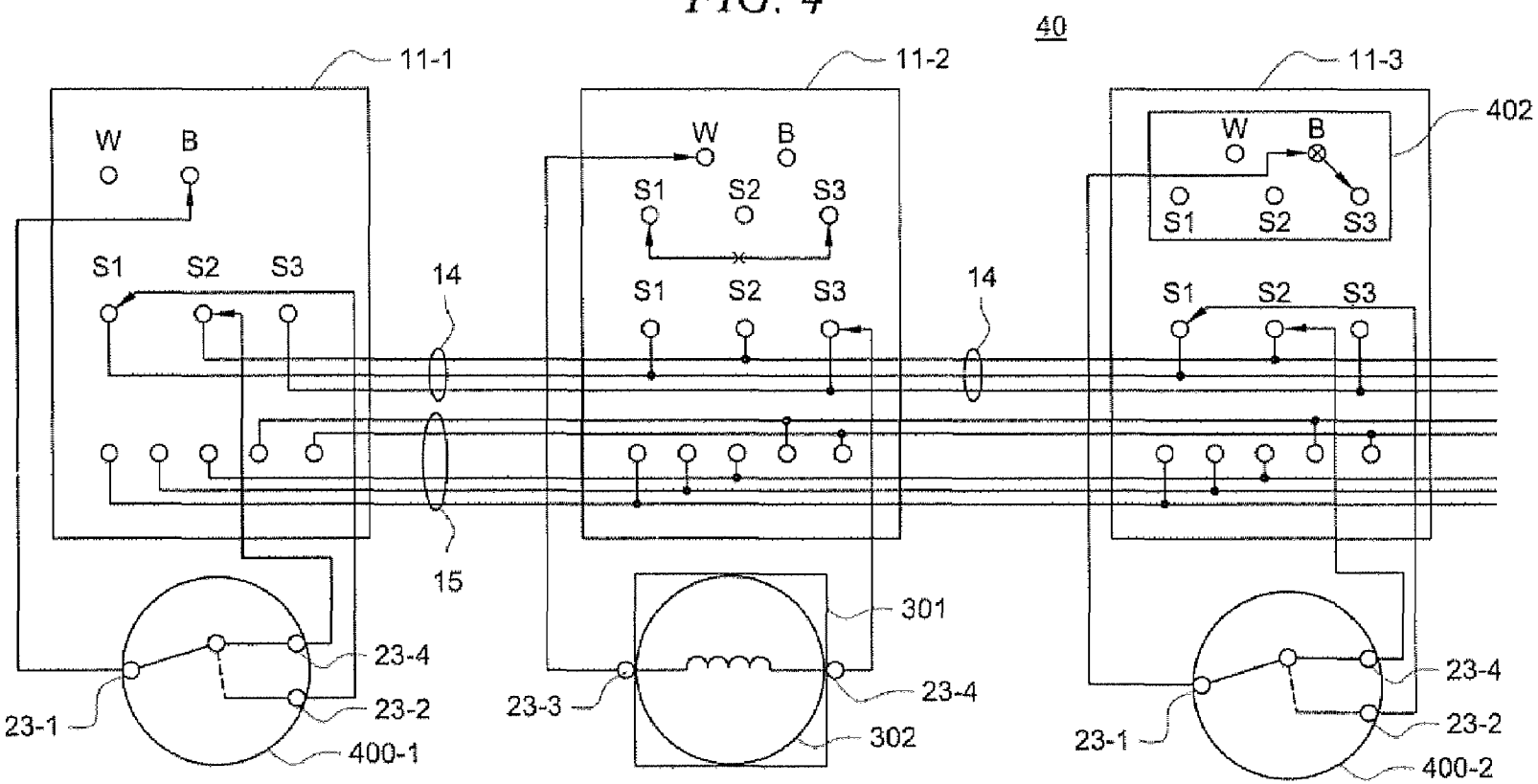

FIG. 4 shows the situation where it is desired to convert the switch operation of lamp 302 into a so called three-way circuit such that lamp 302 can be turned on or off from two different locations. The conversion starts with the removal of plug and play device 301 from shell 11-2. Cross-connect bridge 320 is then removed which essentially removes the jumper between terminals S1 and S3. This can be done by moving pins (either on the bridge or on the device) or simply by cutting the bridge jumper on bridge 320, or by not using a bridge at all.

A three-way switch device, such as device 400-2, is plugged into shell 11-3. Device 400-2 is wired so that terminal 23-1 connects to terminal B. However, bridge 402 blocks the connection to terminal B and instead connects terminal 23-1 to terminal S3. This connection, as discussed above, can be made directly at the switch if desired without using the bridge. In such a situation, terminal 23-1 would be connected to terminal S3.

Switch 300 is removed from shell 11-1 and replaced by three-way switch 400-1 which is wired as shown. This conversion then has the effect of allowing lamp 302 to be operated on or off from either switch 400-1 or 400-2 using the plug/play concepts described herein. Note that this conversion of functional operation occurred without the need for touching main wiring 14 or 15 and thus would not normally require the use of an electrician.

Figure 5:
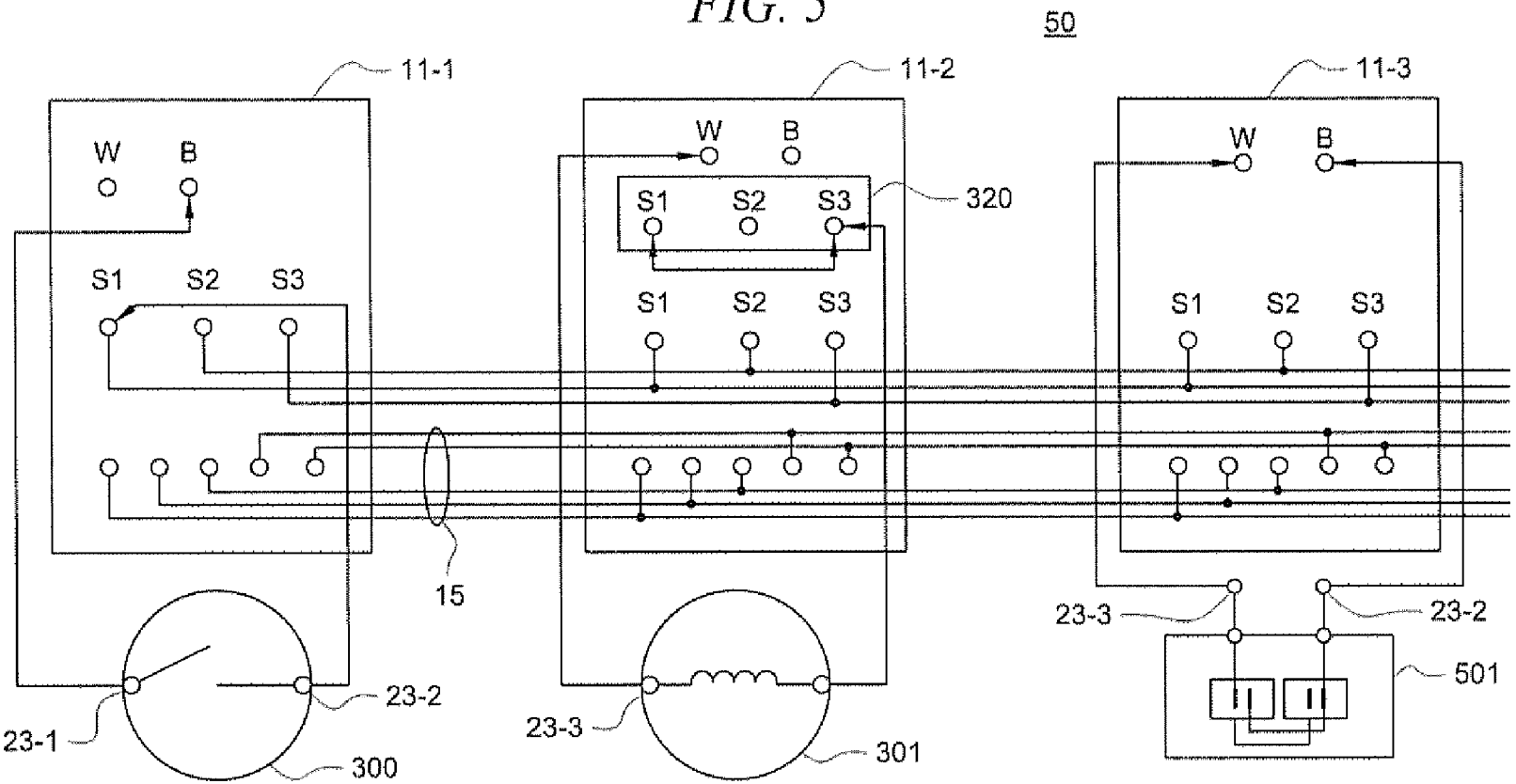

FIG. 5 shows how shell 11-3 can be converted from a switch to an outlet. This is accomplished by removing the switch simply by pulling the switch out of shell 11-3 and inserting in its place outlet 501 which is pre-wired such that the outlet connects to the black and white wires (B & W terminals) of shell 11-3 via terminals 23-3 and 23-2.

Figure 6:
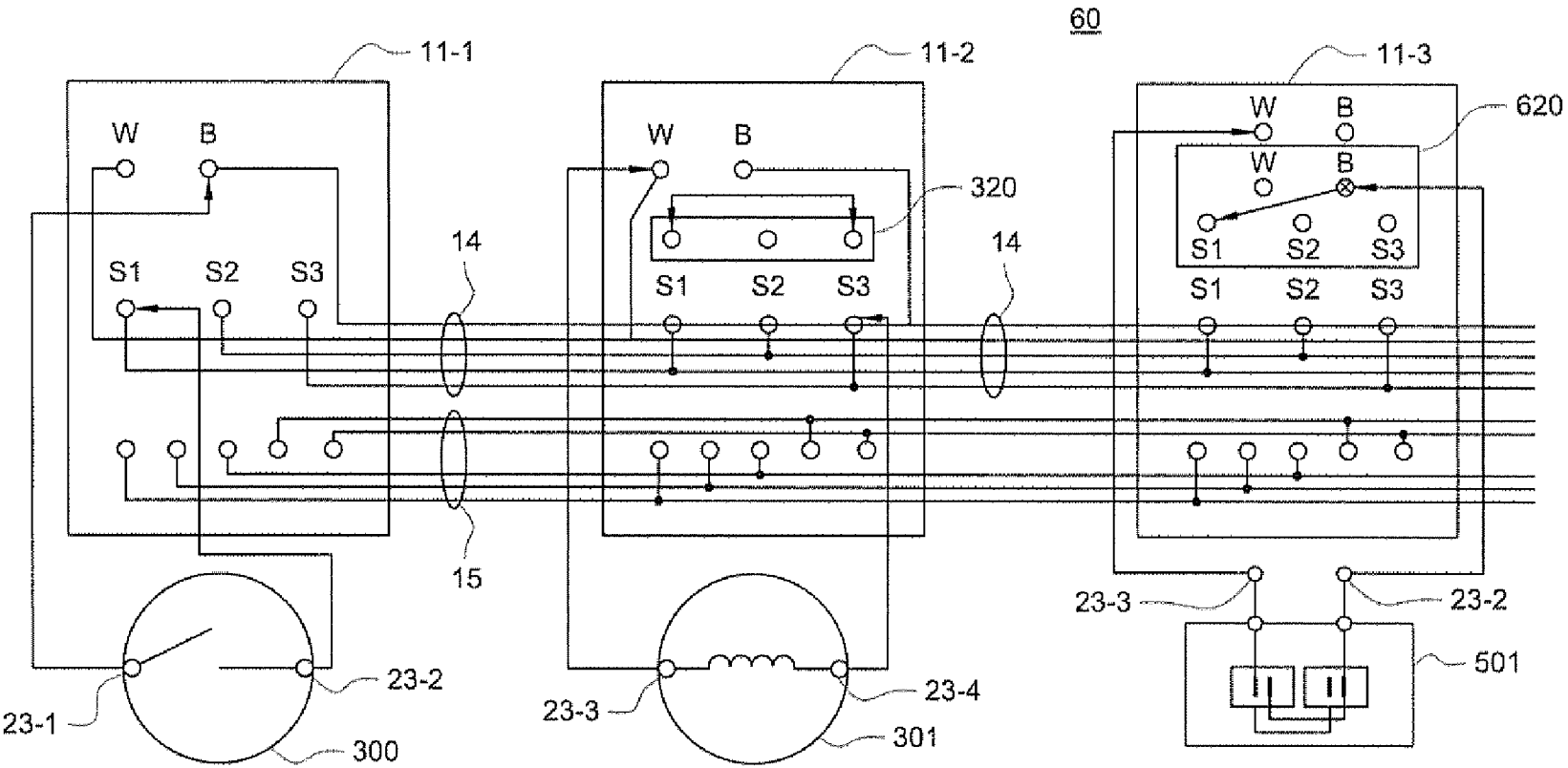

FIG. 6 shows the situation where device 501 becomes a switched outlet simply by inserting bridge 620 between outlet 501 and the connector of shell 11-3. In this manner switch 300 controls the on-off state of outlet 501, in a plug and play manner all without any changes to the power wiring of the premises. Note that while only a few different functions have been discussed herein, any number of different functions can be interchanged, such as, outlet socket, light socket, dimmer, motion detection switch, light-intensity detection switch, touch screen controller, telephone, alarm controller, etc.

Figure 7:
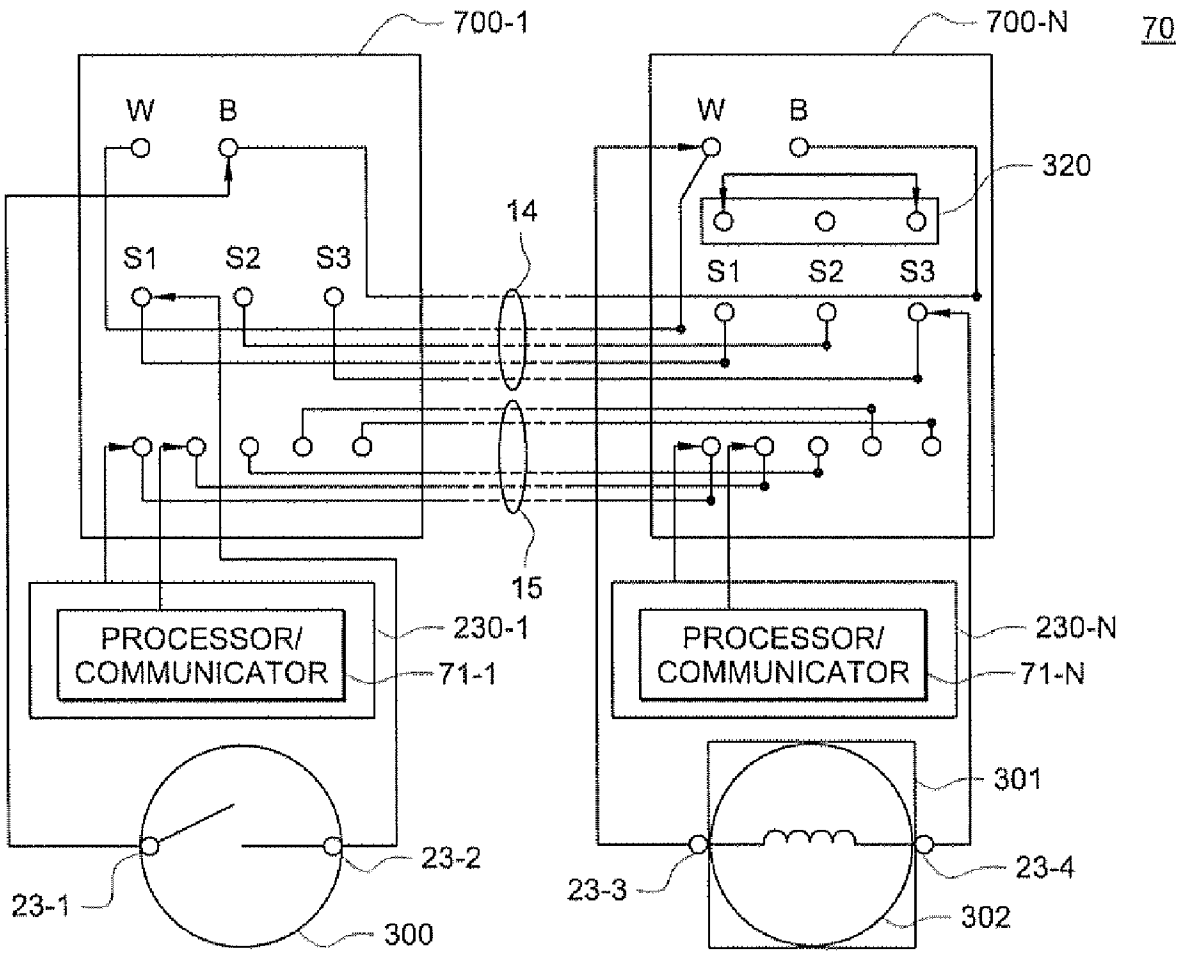
FIG. 7 shows one embodiment of a system having universal control.

FIG. 7 illustrates system 70 having universal control such that processor/communicator 71-1 associated with connector 230-1 in box 700-1 sends messages to one or more other processors, such as processor/communicator 71-N in box 700-N, to inform the system as to what type of device is plugged into box 700-1. Processor/communicator 71-N can be a control processor that then sends control signals to other devices, or processor/communicator 71-N can be a processor in each device for self control of the associated device.

The electrical signals among processors can be any type of signals, including wireless signals and light signals, but advantageously, these signals would be transmitted on one of the wires (such as the power line) interconnecting the boxes or, as shown, the signals can be transmitted on a set of control lines. The signals can be general broadcast signals or can be coded for transmission reception by one or more selected (by address, location, etc.) other devices. Note that optics can be used and thus the terms electrical and wiring include optics and optical cables.

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. An insert for use with a utility box, said insert device comprising:

a shell adapted to be affixed within said utility box affixed to a permanent structure of a premises, said shell having therein at least one electrical connector; said connector having a portion within a body of said shell and a portion extending through a wall of said sell such that wiring within said utility box can be connected to said extending portion and wherein said connector portion within said body of said shell is adapted for mating with control devices; and a control device removably positioned within said body of said shell wherein said control device comprises:

a housing having a footprint designed to fit within said shell;

at least one user accessible device positioned on a face side of said housing;

a plurality of electrical terminals accessible from an exterior section of said housing; said terminals adapted for mating with said electrical connectors of said shell, and at least one processor for controlling the function of said control device.

2. The insert of claim 1 wherein said control device is selected from the list of: power switch, electrical outlet, light switch, thermostat, temperature detection, light-intensity detection, motion detection, vibration detection communications device, humidity detection, fire detection, smoke detection, CO detection, CO2 detection, video detection, video receiver, audio detection, audio receiver, keypad, touchpad, switching, outlet socket, light socket, dimmer, motion detection switch, light-intensity detection switch, touch screen controller, telephone, alarm controller.

3. The device of claim 1 further comprising:

means for changing the connection orientation of said terminals.

4. The device of claim 3 wherein said changing means is selected from the list of: jumper plate, interchangeable terminal pins, jumper wires.

5. The device of claim 1 wherein said processor comprises:

means for communicating with at least one processor associated with another switch, said communicating being by electrical signals transmitted between processors.

* * * * *